US012669279B2

(12) United States Patent
Shi et al.

(10) Patent No.: US 12,669,279 B2
(45) Date of Patent: Jun. 30, 2026

(54) REFRIGERATOR AIR DUCT STRUCTURE, REFRIGERATOR REFRIGERATING AIR DUCT, REFRIGERATOR FREEZING AIR DUCT, AND REFRIGERATOR

(71) Applicant: ANHUI LANJIE INTELLIGENT HOME APPLIANCE CO., LTD., Anhui (CN)

(72) Inventors: Yong Shi, Anhui (CN); Zhengguang Lyu, Anhui (CN)

(73) Assignee: ANHUI LANJIE INTELLIGENT HOME APPLIANCE CO., LTD., Anhui (CN)

( * ) Notice: Subject to any disclaimer, the term of this patent is extended or adjusted under 35 U.S.C. 154(b) by 145 days.

(21) Appl. No.: 18/557,243

(22) PCT Filed: Jul. 23, 2021

(86) PCT No.: PCT/CN2021/108198
§ 371 (c)(1),
(2) Date: Oct. 25, 2023

(87) PCT Pub. No.: WO2022/227305
PCT Pub. Date: Nov. 3, 2022

(65) Prior Publication Data

US 2024/0219099 A1 Jul. 4, 2024

(30) Foreign Application Priority Data

Apr. 26, 2021 (CN) ..... 202110453604.1

(51) Int. Cl.
*F25D 17/08* (2006.01)
*F25D 17/06* (2006.01)
*F25D 23/02* (2006.01)

(52) U.S. Cl.
CPC ..... *F25D 17/08* (2013.01); *F25D 17/062* (2013.01); *F25D 23/028* (2013.01); *F25D 2317/067* (2013.01)

(58) Field of Classification Search
CPC .. F25D 17/08; F25D 17/062; F25D 2317/066; F25D 2317/067; F25D 11/02; F25D 23/00; F25D 23/028
See application file for complete search history.

(56) References Cited

U.S. PATENT DOCUMENTS 6,112,542 A 9/2000 Lee
2009/0038336 A1 2/2009 Gorz et al.
(Continued)

FOREIGN PATENT DOCUMENTS

CN 1127878 A 7/1996
CN 102287990 A 12/2011
(Continued)

OTHER PUBLICATIONS

Extended European Search Report and Written Opinion from EP Application No. 21938771.9 dated May 27, 2024.
(Continued)

*Primary Examiner* — Marc E Norman
(74) *Attorney, Agent, or Firm* — Calfee, Halter & Griswold LLP

(57) ABSTRACT

The present disclosure relates to the technical field of refrigerators and manufacturing therefor, and in particular, to a refrigerator air duct structure, a refrigerator refrigerating air duct, a refrigerator freezing air duct, and a refrigerator. The refrigerator air duct structure comprises a groove integrally formed on a refrigerating container liner and a cover plate covering the groove; the groove is communicated with an air supply duct, and comprises a main groove and a plurality of branch grooves communicated with the main
(Continued)

groove; the plurality of branch grooves are arranged at intervals on the refrigerator container liner; and the cover plate is provided with a through-hole for allowing cold air to flow into a refrigerator body of a refrigerator. According to the present disclosure, the refrigerator air duct structure is naturally formed by means of the cover plate and the plastic groove of the container liner, thereby reducing assembly sub-parts for a refrigerating air duct and a freezing air duct, making operation steps simple during assembly of the air ducts, canceling in-refrigerator splicing operations for conventional air ducts and air supply ports, reducing cold leakage caused by poor sealing, and reducing the risk of freezing at the bottom of a refrigerating chamber and freezing in a freezing chamber.

10 Claims, 4 Drawing Sheets

(56) References Cited

U.S. PATENT DOCUMENTS

| | | | | |
|---|---|---|---|---|
| 2016/0223244 | A1 | 8/2016 | Wait | |
| 2019/0056165 | A1* | 2/2019 | Im | F25D 17/062 |
| 2020/0124339 | A1* | 4/2020 | Cheng | F25D 17/08 |
| 2020/0224958 | A1* | 7/2020 | Park | F25D 17/08 |
| 2022/0341655 | A1* | 10/2022 | Li | F25D 17/067 |

FOREIGN PATENT DOCUMENTS

| | | | |
|---|---|---|---|
| CN | 105042986 | A | 11/2015 |
| CN | 205075323 | U | 3/2016 |
| CN | 107062754 | A | 8/2017 |
| CN | 109605717 | A | 4/2019 |
| CN | 208920706 | U | 5/2019 |
| CN | 209819989 | U | 12/2019 |
| CN | 112303998 | A | 2/2021 |
| CN | 112378145 | A | 2/2021 |
| CN | 112696860 | A | 4/2021 |
| EP | 2336687 | B1 | 7/2017 |
| EP | 1926946 | B1 | 11/2018 |
| EP | 3699520 | A1 | 8/2020 |
| JP | 2010007870 | A | 1/2010 |
| JP | 2010096473 | A | 4/2010 |
| WO | 2006120110 | A1 | 11/2006 |

OTHER PUBLICATIONS

English translation of International Search Report from PCT/CN2021/108198 dated Jan. 26, 2022 (3 pages).

* cited by examiner

REFRIGERATOR AIR DUCT STRUCTURE, REFRIGERATOR REFRIGERATING AIR DUCT, REFRIGERATOR FREEZING AIR DUCT, AND REFRIGERATOR

CROSS-REFERENCE TO RELATED APPLICATIONS

This application is a 371 of PCT/CN2021/108198 filed Jul. 23, 2021, which claims the benefit of Chinese patent application 202110453604.1, filed on Apr. 26, 2021, contents of which are incorporated herein by reference.

FIELD

The present disclosure relates to the technical field of refrigerators and manufacturing therefor, in particular to a refrigerator air duct structure, a refrigerator refrigerating air duct, a refrigerator freezing air duct and a refrigerator.

BACKGROUND

With the progress of science and technology, refrigerators are developed in a trend towards large-volume and thin-walled ones. Compared with refrigerators that have the same size and ordinary foam layer thickness, refrigerators with larger effective volume and higher cost performance are increasingly favored by the consumers.

Large-volume refrigerators have higher requirements for refrigerator parts, such as smaller refrigerating air duct/freezing air duct, and thinner and higher-strength cover plate. However, the existing refrigerating air duct/freezing air duct is assembled from a plurality of sub-parts. FIG. 1 is a schematic structural diagram of an existing refrigerator refrigerating air duct in the prior art. As shown in FIG. 1, after the cover plate is assembled, the refrigerating inner liner 5' is spliced and sealed at the air inlet 6' manually to form an air duct flow path, and the cover plate comprises a metal cover plate 1', a plastic cover plate 2', a foam air duct 3' and sealing sponge 4'. Thus, it can be seen that the existing refrigerator refrigerating air duct has the following disadvantages: (1) there are a large number of sub-parts, the assembling is complex, and the automation level is low; (2) since the air duct is snap-fitted with the refrigerating inner liner, the air duct may be detached from the refrigerating inner liner in the transportation process; (3) cold leakage may occur owing to the sealing failure at the splices between the air duct assembly and the refrigerating inner liner, resulting in freezing at the bottom of the refrigerating chamber.

FIG. 2 is a schematic structural diagram of the refrigerator freezing air duct in the prior art. As shown in FIG. 2, the existing refrigerator freezing air duct consists of a freezing inner liner l', a freezing air supply port 2', an air supply duct 4', a refrigerating air inlet 7', a refrigerating inner liner 6', a refrigerating air return port 8', an air return duct 5' (or an EPS foam air duct), and a freezing air return port 3'; in addition, the air return duct 5' has a complex structure and is spliced from a plurality of parts, and all the splices must be sealed; moreover, condensation and frosting may occur in the freezing chamber.

The Chinese patent application No. CN102287990A discloses a refrigerator and a liner thereof, but a refrigerating liner of the refrigerator is recessed into the refrigerator and occupies a part of the volume of the refrigerator. In addition, since the groove of the refrigerating liner of the refrigerator is large, a cover plate for the groove must have certain thickness to ensure its strength.

SUMMARY

To solve the problems of a large number of parts of refrigerating air duct and freezing air duct, complex assembling, poor refrigerating effect and small effective volume of the refrigerators in the prior art, the present disclosure provides a refrigerator air duct structure, a refrigerator refrigerating air duct, a refrigerator freezing air duct and a refrigerator.

To attain the above object, in a first aspect, the present disclosure provides a refrigerator air duct structure, which comprises a groove integrally formed on a refrigerator inner liner and a cover plate covering the groove, wherein the groove is communicated with an air supply duct and comprises a main groove and a plurality of branch grooves communicated with the main groove, and the plurality of branch grooves are arranged at intervals on the refrigerator inner liner;

and the cover plate is provided with a through-hole for allowing cold air to flow into a refrigerator storage chamber (a refrigerating chamber or a freezing chamber) of a refrigerator.

Optional, there are two branch grooves, namely, a first branch groove and a second branch groove that are arranged at an interval in parallel.

Optional, the air guide direction of the first branch groove is the same as that of the main groove, and an inclined groove is arranged between the second branch groove and the main groove for cold air to circulate.

Optional, an included angle between the length direction of the inclined groove and the length direction of the main groove is 20°-80°.

Optional, a ratio of the cross-sectional area of the first branch groove to the cross-sectional area of the second branch groove is 0.7:1-1.5:1.

Optional, a side of the refrigerator inner liner is provided with a sunk groove for the cover plate to lean against.

Optional, the thickness of the cover plate is 0.5 mm-3 mm.

In a second aspect, the present disclosure provides a refrigerator refrigerating air duct, which comprises the afore-mentioned refrigerator air duct structure.

Optional, the diameter of the through-hole in the cover plate gradually increases from the direction of the main groove to the direction of the branch grooves.

In a third aspect, the present disclosure provides a refrigerator freezing air duct, which comprises the afore-mentioned refrigerator air duct structure.

In a fourth aspect, the present disclosure provides a refrigerator, which has a refrigerating liner and a freezing liner, wherein the refrigerating liner is provided with the afore-mentioned refrigerator refrigerating air duct therein; and/or the freezing liner is provided with the afore-mentioned refrigerator freezing air duct therein.

With the technical scheme described above, the present disclosure attains the following beneficial effects:

(1) A refrigerator air duct structure is naturally formed by the cover plate and the plastic groove of the inner liner, so that the number of assembled sub-parts of the refrigerating air duct and the freezing air duct is decreased, and the operation steps in the air duct assembling work are simple;

(2) The in-refrigerator splicing operation for conventional air ducts and air supply ports is cancelled, so that the cold leakage caused by poor sealing is reduced, and the risk of freezing at the bottom of the refrigerating chamber and the freezing chamber is reduced;

(3) Because the air ducts are formed by backward plastic suction and the thickness of the cover plate is small, the air ducts hardly occupy the volume of the refrigerator liner, thereby the effective volume of the refrigerator can be improved.

Figure 1:
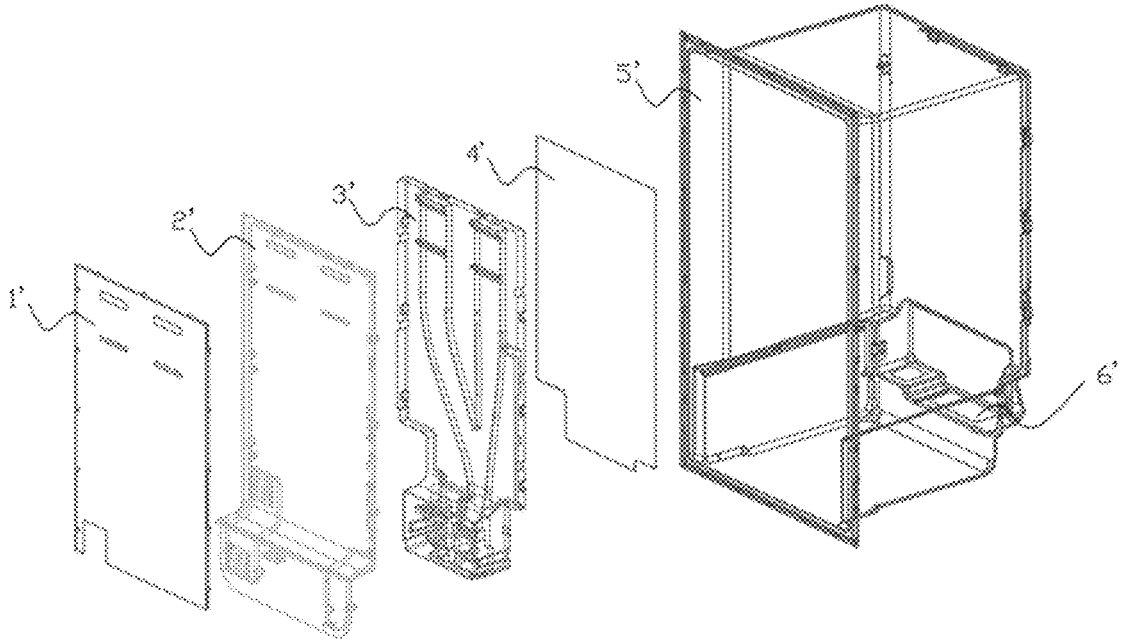
Fig. 1 Prior Art
FIG. 1 is a schematic structural diagram of a refrigerator refrigerating air duct in the prior art.

| Reference Numbers |
|---|
| 1 - cover plate; |
| 2 - insulating layer |
| 3 - container liner |
| 5 - groove |
| 11 - through-hole |
| 50 - main groove |
| 51 - first branch groove |
| 52 - second branch groove |
| 53 - inclined groove |

DETAILED DESCRIPTION

Hereunder some embodiments of the present disclosure will be detailed, with reference to the accompanying drawings. It should be understood that the embodiments described here are only provided to describe and explain the present disclosure, but shall not be deemed as constituting any limitation to the present disclosure.

In the present disclosure, unless otherwise specified, the terms that denote the orientations are used as follows, for example: "top", "bottom", "left" and "right" usually refer to "top", "bottom", "left" and "right" as shown in the accompanying drawings; "inside" and "outside" usually refer to inside and outside in relation to the profiles of the components; and "distal" and "proximal" usually refer to distal and proximal positions with respect to the outlines of the components.

As described above, in a first aspect, the present disclosure provides a refrigerator air duct structure, which comprises a groove 5 integrally formed on a refrigerator inner liner and a cover plate 1 covering the groove 5, wherein the groove 5 is communicated with an air supply duct and comprises a main groove 50 and a plurality of branch grooves communicated with the main groove 50, and the plurality of branch grooves are arranged at intervals on the refrigerator inner liner 3;

and the cover plate 1 is provided with a through-hole 11 for cold air to flow into the storage chamber of the refrigerator.

According to the present disclosure, a groove 5 is produced by plastic suction from the rear of the inner liner 3, and the groove 5 can work with the cover plate 1 to enclose an air duct structure; thus, on one hand, the in-refrigerator splicing operation for the conventional air duct and air supply port is cancelled, the number of sub-parts is decreased, and the assembling is simple; on the other hand, since the number of the spliced parts is decreased, the risk of cold leakage can be reduced and the effective capacity of the refrigerator can be increased.

In the present disclosure, at least two branch grooves are provided, for example, two, three, four, five or more branch grooves may be provided. In order to reasonably distribute the components and reduce the difficulty in groove forming, preferably two branch grooves are provided, namely, a first branch groove 51 and a second branch groove 52 that are arranged at an interval in parallel.

In some preferred embodiments of the present disclosure, cold air can be uniformly distributed in the inner liner 3 by adjusting the air volume in the first branch groove 51 and the second branch groove 52. In the present disclosure, the air volume in the first branch groove 51 and the second branch groove 52 may be adjusted in two ways: (1) adjusting the included angle between the first branch groove 51 and the second branch groove 52 and the main groove 50 in the length direction; and (2) adjusting the cross-sectional area of the part of the first branch groove 51 and the second branch groove 52 in communication with the main groove 50.

According to the present disclosure, preferably, the air guide direction of the first branch groove 51 is the same as that of the main groove 50, and an inclined groove 53 is arranged between the second branch groove 52 and the main groove for cold air to circulate. Further preferably, an included angle between the length direction of the inclined groove 53 and the length direction of the main groove is 20°-80°, preferably 30°-50°, optimally 35°.

According to the present disclosure, a ratio of the cross-sectional area of the first branch groove to the cross-sectional area of the second branch groove 52 is preferably 0.7:1-1.5:1, more preferably 0.9:1-1.1:1, optimally 1:1.

According to the present disclosure, in order to enable the cover plate 1 to fully enclose the groove 5, preferably a side of the refrigerator inner liner is provided with a sunk groove for the cover plate 1 to lean against, so that the cover plate 1 can be confined in the sink groove during assembling to avoid the displacement of the cover plate 1, and reduce the fit clearance between the cover plate 1 and the inner liner, and improve the thermal insulating property of the inner liner as well.

The inventor of the present disclosure has found: if the cross-sectional area of the groove 5 is too large and there is no supporting member in the groove 5, the cover plate 1 covering the groove 5 must have high strength, and usually shall be made of a heavy-duty plate, such as a plate in thickness of 3.5 mm or a ribbed plate.

According to the present disclosure, since the groove 5 consists of a plurality of branch grooves, bosses (with respect to the groove) are formed between the plurality of branch grooves, and the bosses are in the same plane as the refrigerator liner, and can support the cover plate 1, so that the cover plate 1 doesn't have to utilize a plate that has great thickness and high strength, i.e., a conventional cover plate may be used; preferably, the cover plate is in thickness of 0.5 mm-3 mm, more preferably 0.5 mm-2 mm, thereby the cost and volume of the cover plate may be reduced, and the effective volume of the refrigerator may be further increased.

In the present disclosure, there is no particular requirement for the type of the cover plate; for example, the cover plate may be made of a common material used for the refrigerator liner, such as a plastic cover plate or a metal cover plate. In order to further improve the thermal insulating property of the refrigerator liner, preferably, the cover plate 1 comprises a panel and an insulating layer, and the insulating layer may be of a type well-known to those skilled in the art, such as sponge.

In the present disclosure, the assembling method of the air duct structure is simple, for example, the assembling method may comprise the following steps:

(1) bonding an insulating layer on the back of a panel (the surface of the panel is the appearance surface) to form a cover plate 1, which is grabbed by a robotic arm at the production line;

(2) applying glue to predetermined positions on the periphery of the back of the inner liner and/or the cover plate 1, and pressing firmly to accomplish the assembling, so as to form an air duct structure.

In a second aspect, the present disclosure provides a refrigerator refrigerating air duct, which comprises the afore-mentioned refrigerator air duct structure.

Figure 5:
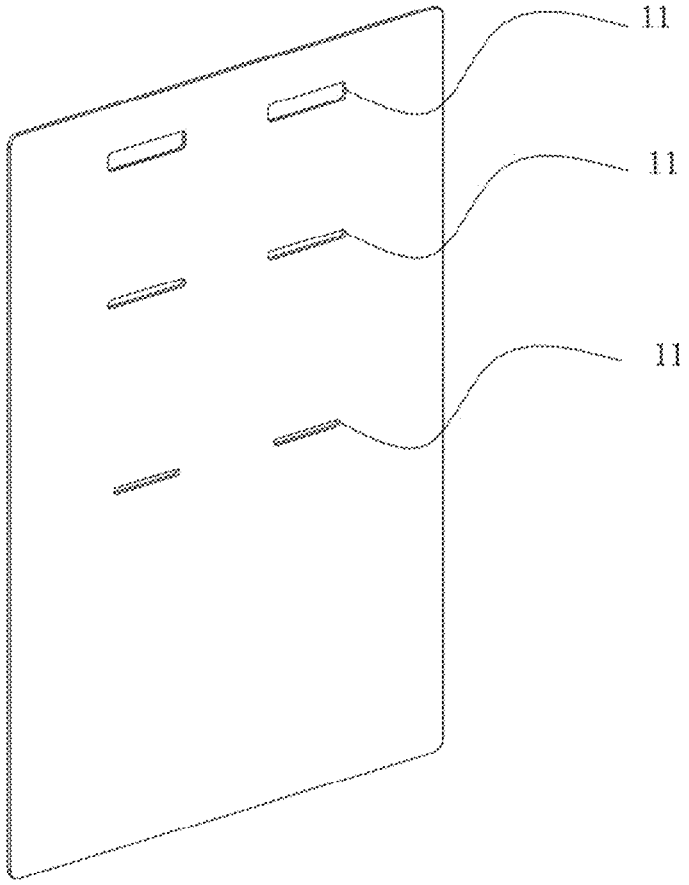
FIG. 5 is a schematic structural diagram of the cover plate according to an embodiment of the present disclosure.

FIG. 5 is a schematic structural diagram of the cover plate according to an embodiment of the present disclosure. As shown in FIG. 5, according to the present disclosure, preferably, the diameter of the through-hole in the cover plate 1 gradually increases from the direction of the main groove 50 to the direction of the branch grooves, so that the volume of air into the inner liner can be adjusted and the cold air enters the refrigerator liner uniformly.

Figure 2:
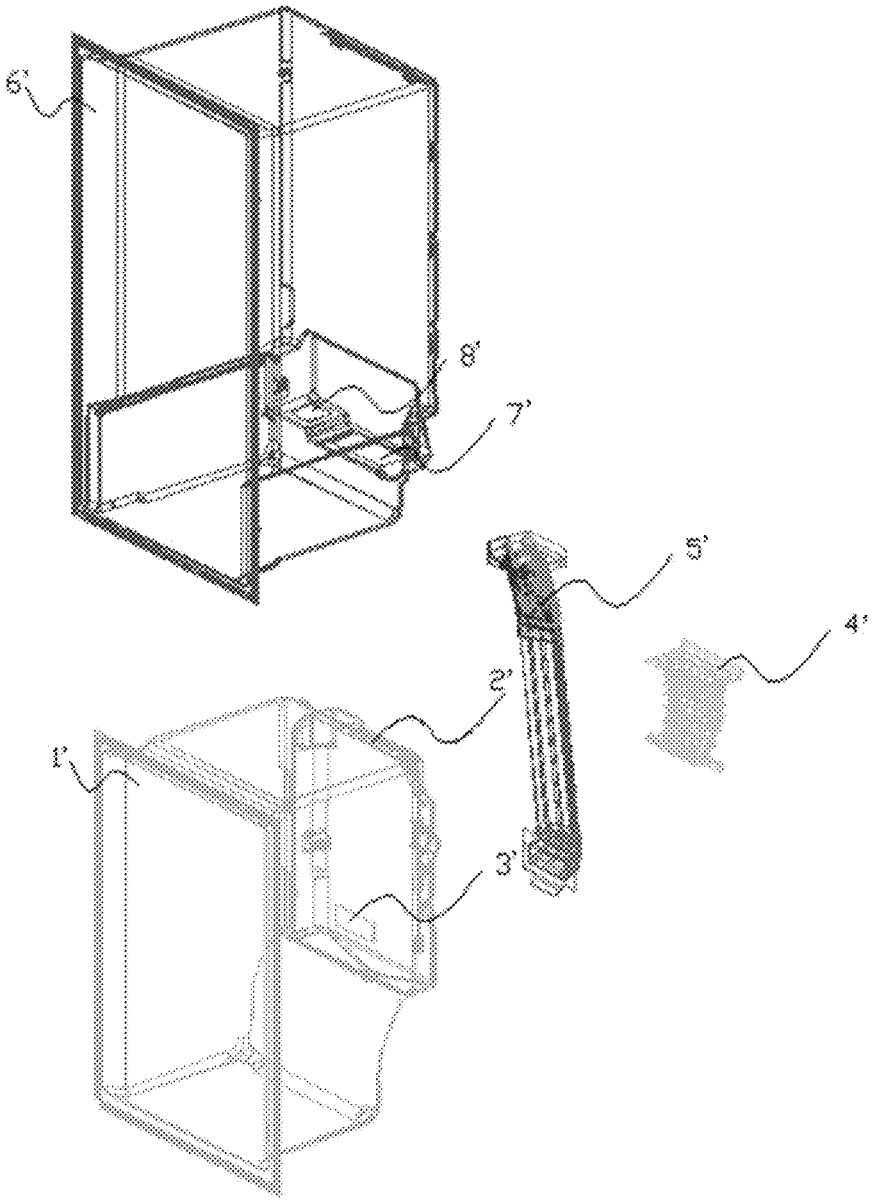
Fig. 2 Prior Art
FIG. 2 is a schematic structural diagram of a refrigerator freezing air duct in the prior art.

FIG. 2 is a schematic structural diagram of the refrigerator refrigerating air duct according to an embodiment of the present disclosure. As shown in FIG. 2, the refrigerator refrigerating air duct comprises a groove 5 integrally formed on the refrigerating inner liner and a cover plate 1 covering the groove; the groove 5 is communicated with an air supply duct, and comprises a main groove 50 and two branch grooves communicated with the main groove; the two branch grooves are arranged at an interval on the refrigerating inner liner; the air guide direction of the first branch groove 51 is the same as that of the main groove 50, and an inclined groove 53 is arranged between the second branch groove 52 and the main groove for cold air to circulate. Preferably, the included angle between the length direction of the inclined groove 53 and the length direction of the main groove is 30°-50°, and the ratio of the cross-sectional area of the first branch groove to the cross-sectional area of the second branch groove 52 is 0.9:1-1.1:1. The cover plate 1 is provided with a through-hole 11 for cold air to flow into the refrigerating chamber, and the diameter of the through-hole in the cover plate 1 gradually increases from the direction of the main groove 50 to the direction of the branch grooves.

In a third aspect, the present disclosure provides a refrigerator freezing air duct, which comprises the afore-mentioned refrigerator air duct structure.

Figure 3:
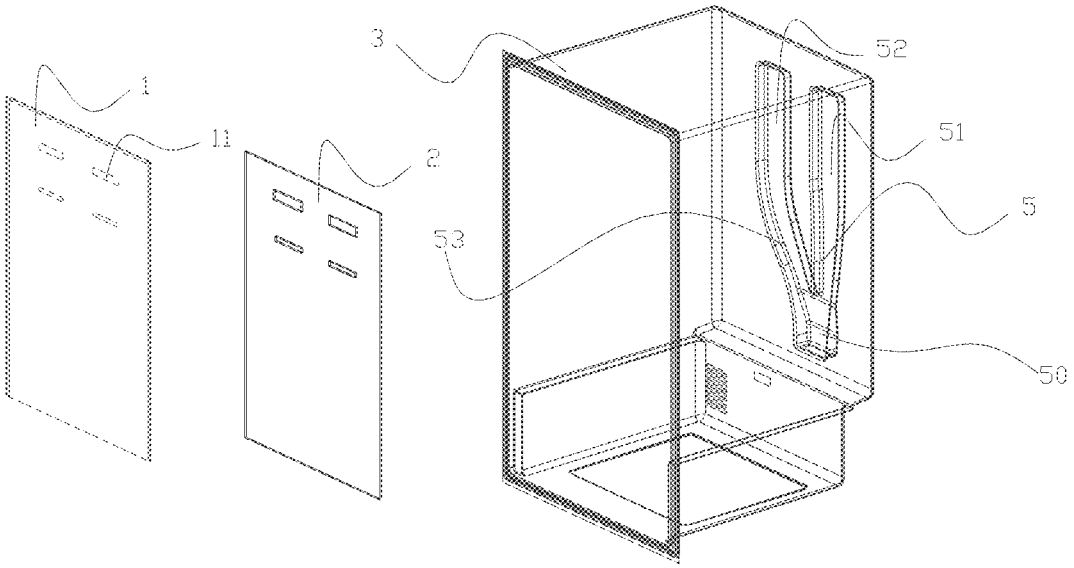
FIG. 3 is a schematic structural diagram of the refrigerator refrigerating air duct according to an embodiment of the present disclosure.
Figure 4:
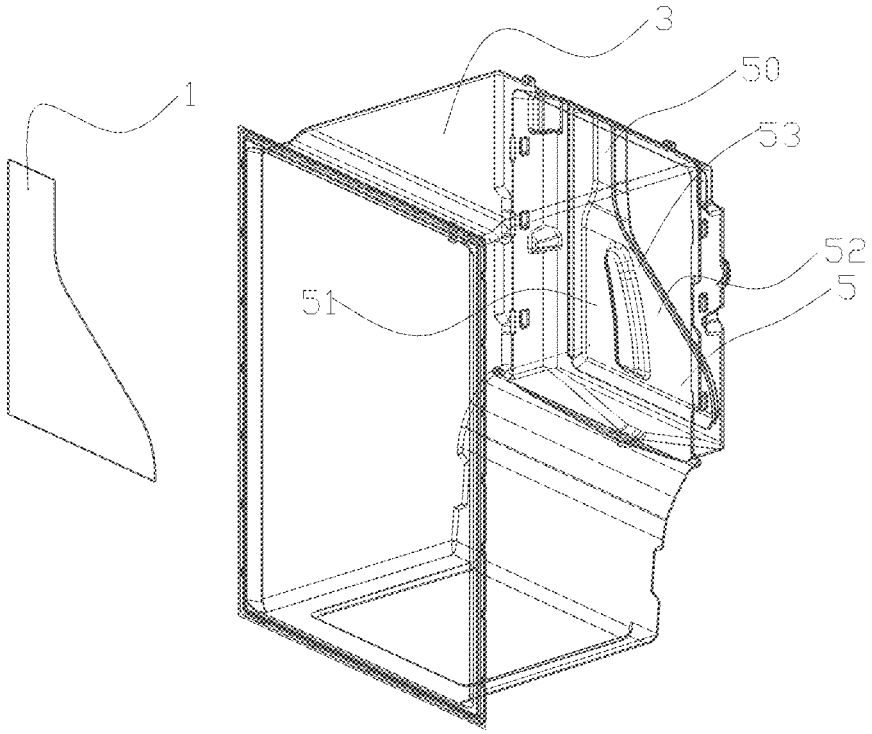
FIG. 4 is a schematic structural diagram of the refrigerator freezing air duct according to an embodiment of the present disclosure.

FIG. 3 is a schematic structural diagram of the refrigerator freezing air duct according to an embodiment of the present disclosure. As shown in FIG. 3, the refrigerator freezing air duct comprises a groove 5 integrally formed on the freezing inner liner and a cover plate 1 covering the groove; the groove 5 is communicated with an air supply duct 4, and comprises a main groove 50 and two branch grooves communicated with the main groove; the two branch grooves are arranged at an interval on the freezing inner liner; the air guide direction of the first branch groove 51 is the same as that of the main groove 50, and an inclined groove 53 is arranged between the second branch groove 52 and the main groove for cold air to circulate. Preferably, the included angle between the length direction of the inclined groove 53 and the length direction of the main groove is 35°-45°, and the ratio of the cross-sectional area of the first branch groove to the cross-sectional area of the second branch groove 52 is 1:1.

Preferably, the cover plate of the refrigerator freezing air duct is a metal cover plate or a plastic cover plate coated with aluminum foil, which has excellent thermal conductivity. When the evaporator defrosts, the heat emitted by the defrosting heater can be introduced into the air return duct, and the defrosting/deicing in the air return duct is finished when the sensor for the air return duct reaches a preset temperature. An air return duct heater for the refrigerator freezing air duct is cancelled on the basis of ensuring complete defrosting inside the air return duct, thereby the energy consumption of the refrigerator and the safety risk are reduced.

In a fourth aspect, the present disclosure provides a refrigerator, which has a refrigerating inner liner and a freezing inner liner, wherein the refrigerating inner liner is provided with the afore-mentioned refrigerator refrigerating air duct therein; and/or the freezing inner liner is provided with the afore-mentioned refrigerator freezing air duct therein.

While the present disclosure is described above in detail in some preferred embodiments with reference to the accompanying drawings, the present disclosure is not limited to those embodiments. Various simple variations may be made to the technical scheme in the present disclosure, including combinations of the specific technical features in any appropriate form, within the scope of the technical ideal of the present disclosure. To avoid unnecessary repetition, various possible combinations are not described specifically in the present disclosure. However, such simple variations and combinations shall also be deemed as having been disclosed and falling in the scope of protection of the present disclosure.

The invention claimed is:

1. A refrigerator air duct structure, comprising a groove integrally formed on a refrigerator inner liner and a cover plate covering the groove, the refrigerator inner liner forms a main structural wall of a refrigerator storage chamber, wherein the groove is communicated with an air supply duct and comprises a main groove and a plurality of branch grooves communicated with the main groove, and the plurality of branch grooves are arranged at intervals on the refrigerator inner liner;

and the cover plate is provided with a through-hole for cold air to flow into the refrigerator storage chamber.

2. The refrigerator air duct structure of claim 1, wherein there are two branch grooves, comprising a first branch groove and a second branch groove that are arranged at an interval in parallel.

3. The refrigerator air duct structure of claim 2, wherein an air guide direction of the first branch groove is the same as that of the main groove, and an inclined groove is arranged between the second branch groove and the main groove for cold air to circulate.

4. The refrigerator air duct structure of claim 3, wherein an included angle between the length direction of the inclined groove and the length direction of the main groove is 20°-80°.

5. The refrigerator air duct structure of claim 2, wherein a ratio of the cross-sectional area of the first branch groove to the cross-sectional area of the second branch groove is 0.7:1-1.5:1.

6. The refrigerator air duct structure of claim 1, wherein a side of the refrigerator inner liner is provided with a sunk groove for the cover plate to lean against.

7. The refrigerator air duct structure of claim 6, wherein the thickness of the cover plate is 0.5 mm-3 mm.

8. A refrigerator refrigerating air duct, comprising the refrigerator air duct structure of claim 1.

9. The refrigerator refrigerating air duct of claim 8, wherein the cover plate is provided with a plurality of through-holes, which are arranged in the direction from the main groove to the branch grooves and increase in size.

10. A refrigerator, comprising a refrigerating inner liner and a freezing inner liner, wherein the refrigerating inner liner is provided with the refrigerator refrigerating air duct of claim 8 therein; and/or the freezing inner liner is provided with a refrigerator freezing air duct therein, the refrigerator freezing air duct comprises the refrigerator air duct structure of claim 1.

* * * * *